US012674582B2

(12) United States Patent
Johnson et al.

(10) Patent No.: US 12,674,582 B2
(45) Date of Patent: Jul. 7, 2026

(54) COOKING APPLIANCE AND METHOD OF OPERATING THE SAME TO SYNCHRONIZE COOKING TIMES FOR MULTIPLE ZONES

(71) Applicant: Haier US Appliance Solutions, Inc., Wilmington, DE (US)

(72) Inventors: Eric Scott Johnson, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 574 days.

(21) Appl. No.: 18/308,194

(22) Filed: Apr. 27, 2023

(65) Prior Publication Data

US 2024/0361002 A1 Oct. 31, 2024

(51) Int. Cl.
*F24C 7/08* (2006.01)
*F24C 3/12* (2006.01)

(52) U.S. Cl.
CPC ..... *F24C 7/087* (2013.01); *F24C 3/128* (2013.01); *F24C 7/085* (2013.01)

(58) Field of Classification Search
CPC .... F24C 7/00; F24C 7/002; F24C 7/04; F24C 7/043; F24C 7/046; F24C 7/06; F24C 7/062; F24C 7/067; F24C 7/08; F24C 7/081; F24C 7/082; F24C 7/085; F24C 7/086; F24C 7/087; F24C 7/088; F24C 3/042; F24C 3/045; F24C 3/047126; F24C 3/128
See application file for complete search history.

(56) References Cited

U.S. PATENT DOCUMENTS

| | | | |
|---|---|---|---|
| 4,302,661 | A | 11/1981 | Perry, Jr. |
| 6,114,663 | A | 9/2000 | Stockley |
| 6,355,914 | B1 | 3/2002 | Stockley |
| 6,710,308 | B2 | 3/2004 | Sauter et al. |
| 6,734,403 | B2 | 5/2004 | Baker et al. |
| 6,773,738 | B2 | 8/2004 | Berger et al. |
| 6,777,652 | B2 | 8/2004 | Stockley |
| 7,087,867 | B2 | 8/2006 | Stockley |
| 7,126,088 | B2 | 10/2006 | Horton et al. |

(Continued)

FOREIGN PATENT DOCUMENTS

| | | | |
|---|---|---|---|
| CA | 3139744 | C | 5/2022 |
| EP | 3384775 | A1 | 10/2018 |

(Continued)

*Primary Examiner* — Hung D Nguyen
(74) *Attorney, Agent, or Firm* — Dority & Manning, P.A.

(57) ABSTRACT

A method of operating a cooking appliance includes receiving one or more inputs for a cooking sequence including a first food item at a first temperature and a second food item at a second temperature; determining a first energy transfer value for the first food item and a second energy transfer value for the second food item; comparing the first energy transfer value to the second energy transfer value according to the first and second temperatures; determining a synchronized cooking time for each of the first food item and the second food item based on the first energy transfer value and the second energy transfer value; and adjusting one or more operational parameters of the cooking sequence in response to determining the synchronized cooking time.

20 Claims, 6 Drawing Sheets

(56) References Cited

U.S. PATENT DOCUMENTS

| | | | | |
|---|---|---|---|---|
| 7,372,000 | B2 | 5/2008 | Stockley | |
| 7,446,282 | B2 | 11/2008 | Shei et al. | |
| 8,138,453 | B2 | 3/2012 | Yang et al. | |
| 8,426,777 | B2 | 4/2013 | Elston, III et al. | |
| 8,455,028 | B2 | 6/2013 | Breunig et al. | |
| 8,525,080 | B2 | 9/2013 | Ruther | |
| 8,669,500 | B2 | 3/2014 | Hensel et al. | |
| 8,748,783 | B2 | 6/2014 | Hensel et al. | |
| 8,878,106 | B2 | 11/2014 | Hensel et al. | |
| 9,310,085 | B2 | 4/2016 | Breunig et al. | |
| 9,777,928 | B2 | 10/2017 | Boedicker et al. | |
| 10,034,576 | B2 | 7/2018 | Barth et al. | |
| 10,064,244 | B2 | 8/2018 | Cheng et al. | |
| 10,085,592 | B1 | 10/2018 | Cheng | |
| 10,210,444 | B2 | 2/2019 | Kamei et al. | |
| 10,223,933 | B1 | 3/2019 | Cheng et al. | |
| 10,502,430 | B1 | 12/2019 | Alvey et al. | |
| 10,890,336 | B2 | 1/2021 | McKee et al. | |
| 11,116,348 | B2 | 9/2021 | Kwon et al. | |
| 11,175,048 | B2 | 11/2021 | Murad | |
| 11,252,792 | B2 | 2/2022 | Seddik | |
| 11,257,394 | B2 | 2/2022 | Cheng et al. | |
| 2006/0289436 | A1 | 12/2006 | Carbone et al. | |
| 2007/0039945 | A1 | 2/2007 | Stockley | |
| 2010/0006561 | A1 | 1/2010 | Hensel et al. | |
| 2010/0276417 | A1* | 11/2010 | Uchiyama | F24C 15/325 219/719 |
| 2013/0334197 | A1* | 12/2013 | Kim | F24C 15/007 219/403 |
| 2017/0017248 | A1 | 1/2017 | Armstrong et al. | |
| 2018/0295676 | A1 | 10/2018 | Cheng et al. | |
| 2019/0008320 | A1 | 1/2019 | Cheng | |
| 2019/0053332 | A1 | 2/2019 | Cheng et al. | |
| 2019/0086143 | A1 | 3/2019 | Liss et al. | |
| 2019/0139446 | A1 | 5/2019 | Cheng et al. | |
| 2020/0033811 | A1 | 1/2020 | Helms et al. | |
| 2020/0263874 | A1 | 8/2020 | Cheng | |
| 2020/0329909 | A1 | 10/2020 | Conrad et al. | |
| 2021/0227647 | A1 | 7/2021 | Jeong et al. | |
| 2021/0231311 | A1 | 7/2021 | Ye et al. | |
| 2021/0298333 | A1 | 9/2021 | Strong et al. | |
| 2021/0353097 | A1 | 11/2021 | Jeong et al. | |
| 2021/0372630 | A1 | 12/2021 | Murad | |
| 2021/0401215 | A1 | 12/2021 | Kwon et al. | |
| 2022/0046931 | A1 | 2/2022 | Iantorno et al. | |
| 2022/0065457 | A1 | 3/2022 | Bailey | |
| 2022/0065459 | A1 | 3/2022 | Murad | |
| 2022/0163212 | A1 | 5/2022 | Mitrik et al. | |
| 2022/0163214 | A1 | 5/2022 | Shinohara et al. | |
| 2022/0163261 | A1 | 5/2022 | Cadima | |
| 2022/0186937 | A1 | 6/2022 | Murad | |
| 2023/0087445 | A1* | 3/2023 | Jeong | H05B 6/6482 219/728 |

FOREIGN PATENT DOCUMENTS

| | | | |
|---|---|---|---|
| JP | H06235527 | A | 8/1994 |
| JP | 2004212012 | A | 7/2004 |
| JP | 6006190 | B2 | 10/2016 |
| KR | 20050079522 | A | 8/2005 |
| KR | 100821745 | B1 | 4/2008 |
| KR | 20080095551 | A | 10/2008 |
| WO | WO2014041460 | A1 | 3/2014 |
| WO | WO2014044627 | A2 | 3/2014 |
| WO | WO2019068193 | A1 | 4/2019 |
| WO | WO2021098474 | A1 | 5/2021 |
| WO | WO2021195774 | A1 | 10/2021 |
| WO | WO2022061464 | A1 | 3/2022 |
| WO | WO2022063593 | A1 | 3/2022 |

* cited by examiner

COOKING APPLIANCE AND METHOD OF OPERATING THE SAME TO SYNCHRONIZE COOKING TIMES FOR MULTIPLE ZONES

FIELD OF THE INVENTION

The present subject matter relates generally to cooking appliances, and more particularly to multi-zone oven appliances and methods for operating the same.

BACKGROUND OF THE INVENTION

Oven appliances generally include a cabinet that defines a cooking chamber for cooking food items therein, such as by baking or broiling the food items. In order to perform the cooking operation, oven appliances typically include one or more heat sources, or heating elements, provided in various locations within the cooking chamber. These heat sources may be used together or individually to perform various specific cooking operations, such as baking, broiling, roasting, and the like.

Some oven appliances may be able to perform cooking operations on multiple food items simultaneously by allocating zones within the cooking chamber. However, current oven appliances are not able to determine, or may only approximate different cooking times or power levels of different food items placed in the cooking chamber. Accordingly, the cooking operations on multiple food items require constant tracking of food items and cooking times, depending on what is being cooked, the state at which it is placed in the cooking chamber, and the accuracy of the cooking algorithms. Moreover, when cooking multiple items together, users may have to interrupt some cooking sequences to add or remove food items that have shorter cook times than other food items.

Accordingly, a method of operating a cooking appliance that obviates one or more of these drawbacks would be beneficial. Particularly, a method of operating an oven appliance that is able to account for multiple food items with different cook times or cooking parameters would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include a cabinet forming a cooking chamber, the cooking chamber defining a plurality of cooking zones therein; a plurality of heating elements provided within the cooking chamber; a user interface configured to receive inputs; and a controller operably connected with the plurality of heating elements and the user interface, the controller configured to perform an operation. The operation may include receiving one or more inputs for a cooking sequence including a first temperature and a first cooking time for a first cooking zone of the plurality of cooking zones and a second temperature and a second cooking time for a second cooking zone of the plurality of cooking zones; determining a first energy transfer value for the first cooking zone and a second energy transfer value for the second cooking zone; comparing the first energy transfer value to the second energy transfer value according to the first and second temperatures; determining a synchronized cooking time for each of the first cooking zone and the second cooking zone based on the first energy transfer value and the second energy transfer value; and adjusting one or more operational parameters of the cooking sequence in response to determining the synchronized cooking time.

In another exemplary aspect of the present disclosure, a method of operating a cooking appliance is provided. The cooking appliance may include a cooking chamber defining a plurality of cooking zones, a plurality of heating elements provided within the cooking chamber, and a user interface configured to receive inputs. The method may include receiving one or more inputs for a cooking sequence including a first temperature and a first cooking time for a first cooking zone of the plurality of cooking zones and a second temperature and a second cooking time for a second cooking zone of the plurality of cooking zones; determining a first energy transfer value for the first cooking zone and a second energy transfer value for the second cooking zone; comparing the first energy transfer value to the second energy transfer value according to the first and second temperatures; determining a synchronized cooking time for each of the first cooking zone and the second cooking zone based on the first energy transfer value and the second energy transfer value; and adjusting one or more operational parameters of the cooking sequence in response to determining the synchronized cooking time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
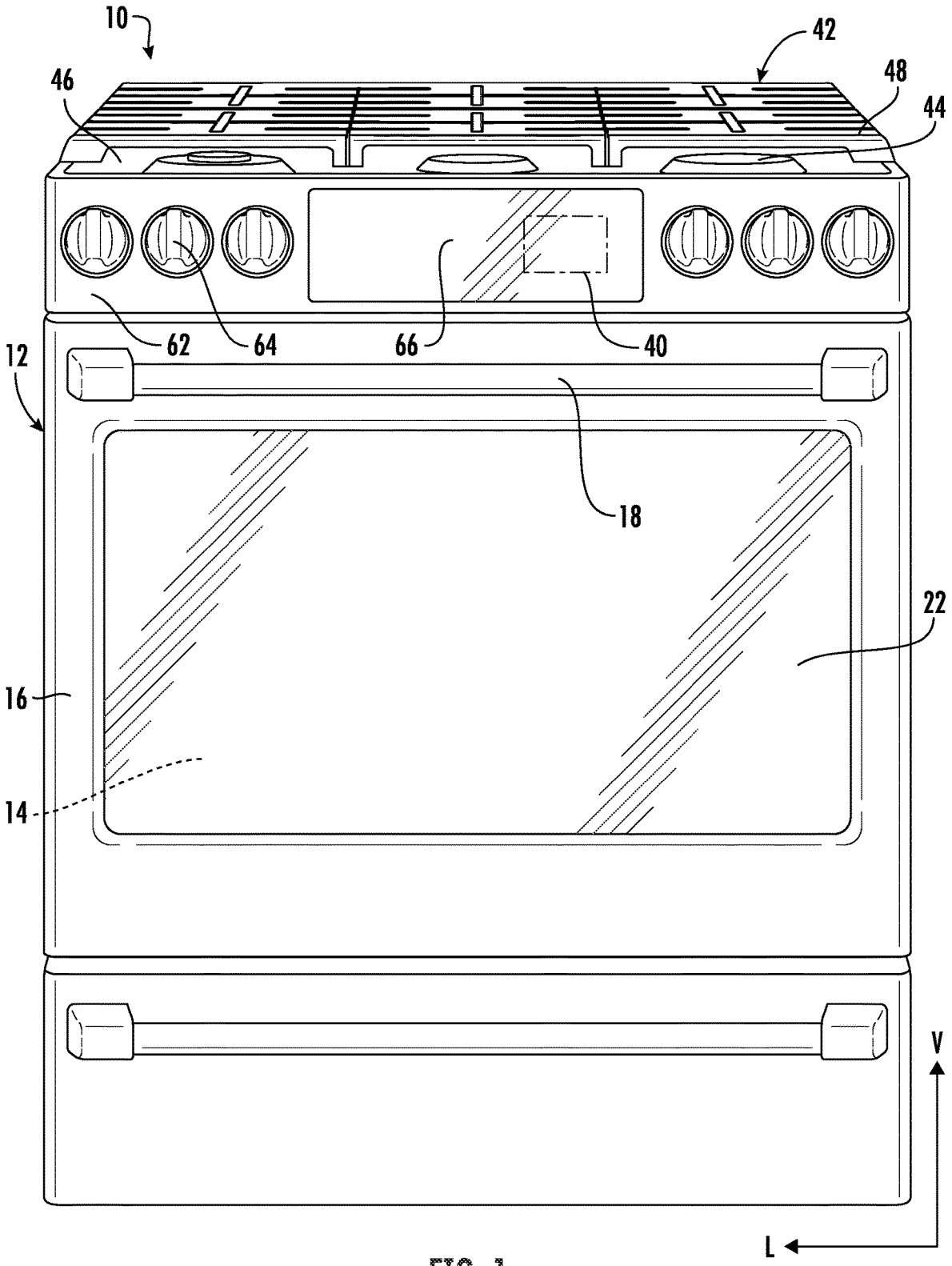
FIG. 1 provides a front view of an exemplary cooking appliance with the door in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view of a cooking appliance 10 according to exemplary embodiments of the present disclosure. Generally, cooking appliance 10 defines a vertical direction V, a lateral direction L, and a transverse direction T. The vertical direction V, lateral direction L, and transverse direction T are mutually perpendicular and form an orthogonal direction system. As will be understood, cooking appliance 10 is provided by way of example only, and the present subject matter may be used in any suitable appliance. Thus, the present disclosure may be used with other oven, range, or countertop appliance configurations (e.g., configurations that define multiple interior cavities for the receipt of food or are otherwise different than the configuration shown in FIG. 1), as well as other suitable appliances, as would be understood in light of the present disclosure.

Cooking appliance 10 may include an insulated cabinet 12 with an interior cooking chamber 14 defined by an interior surface of cabinet 12. Cooking chamber 14 is configured for the receipt of one or more food items to be cooked. Cooking appliance 10 includes a door 16 rotatably mounted to cabinet 12 (e.g., with a hinge—not shown). A handle 18 may be mounted to door 16 and may assist a user with opening and closing door 16 in order to access an opening to cooking chamber 14. For example, a user can pull on handle 18 to open or close door 16 and access cooking chamber 14 through the opening. As will be described below, one or more internal heating elements (e.g., baking, broiling, or convection heating elements) may be provided within cooking chamber 14 to cook or otherwise heat items therein.

Cooking appliance 10 may include a seal (not shown) between door 16 and cabinet 12 that assist with maintaining heat and cooking fumes within cooking chamber 14 when door 16 is closed, as shown in FIG. 1. One or more parallel glass panes 22 provide for viewing the contents of cooking chamber 14 when door 16 is closed and assist with insulating cooking chamber 14. Optionally, one or more baking racks may be positioned in cooking chamber 14 for the receipt of food items or utensils containing food items.

Cooking appliance 10 may include a cooktop surface 42 having one or more heating elements 44 for use in heating or cooking operations. In exemplary embodiments, cooktop surface 42 is comprised of a metal (e.g., steel) panel 46 on which one or more grates 48 may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element may include a burner element, electric heat element, induction element, or another suitable heating element.

Some embodiments of cooking appliance 10 include a controller 40 (e.g., configured to control one or more operations of cooking appliance 10). For example, controller 40 may control at least one operation of cooking appliance 10 that includes an internal heating element or cooktop heating element 44. Controller 40 may be in communication (via for example a suitable wired or wireless connection) with one or more of heating element(s) 44 and other suitable components of cooking appliance 10, as discussed herein. In general, controller 40 may be operable to configure cooking appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout cooking appliance 10. As illustrated, controller 40 may be located within a user interface 62 of cooking appliance 10. In some such embodiments, input/output ("I/O") signals may be routed between controller 40 and various operational components of cooking appliance 10, such as heating element(s) 44, control knobs 64, display component 66, sensors, alarms, or other components as may be provided. For instance, signals may be directed along one or more wiring harnesses that may be routed through cabinet 12. In some embodiments, controller 40 is in communication with user interface assembly 62 and control knobs 64 through which a user may select various operational features and modes and monitor progress of cooking appliance 10. In one embodiment, user interface assembly 62 may represent a general purpose I/O ("GPIO") device or functional block. In one embodiment, user interface assembly 62 may include input components, such as one or more of a variety of electrical, mechanical, or electro-mechanical input devices including rotary dials, push buttons, and touch pads. User interface assembly 62 may include a display component 66, such as a digital or analog display configured to provide operational feedback to a user.

While cooking appliance 10 is shown as a cooktop oven combination, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the user interface assembly 62, as mentioned above, are possible. As another example, cooking appliance 10 may include multiple doors 16 instead of or in addition to the single door 16 illustrated. Such examples include a dual cavity oven, a French door oven, and others. The examples described herein are provided by way of illustration only and without limitation.

User interface assembly 62 (e.g., display 66) may include one or more touch controls. For instance, display 66 may be a touch display (e.g., capacitive touch, proximity touch, pressure switch, etc.) capable of receiving touch inputs from a user relating to cooking operations. Additionally or alternatively, user interface assembly 62 may include one or more additional touch controls separate from display 66 that are capable of receiving touch inputs to control cooking appliance 10. User selections may then be displayed on display 66 to provide visual confirmation to the user of selections made. For instance, multiple selections may be made before initiating a particular cooking operation, as will be described in more detail below.

According to some embodiments, cooking appliance 10 (e.g., within cooking chamber 14) is capable of cooking multiple items at different temperatures within cooking chamber 14. In detail, the cooking operation may receive a plurality of inputs (e.g., user inputs) relating to a plurality of cooking zones (described below) within cooking chamber 14. Accordingly, user interface assembly 62 may prompt a user to select a cooking mode to initiate the specified cooking operation.

Figure 2:
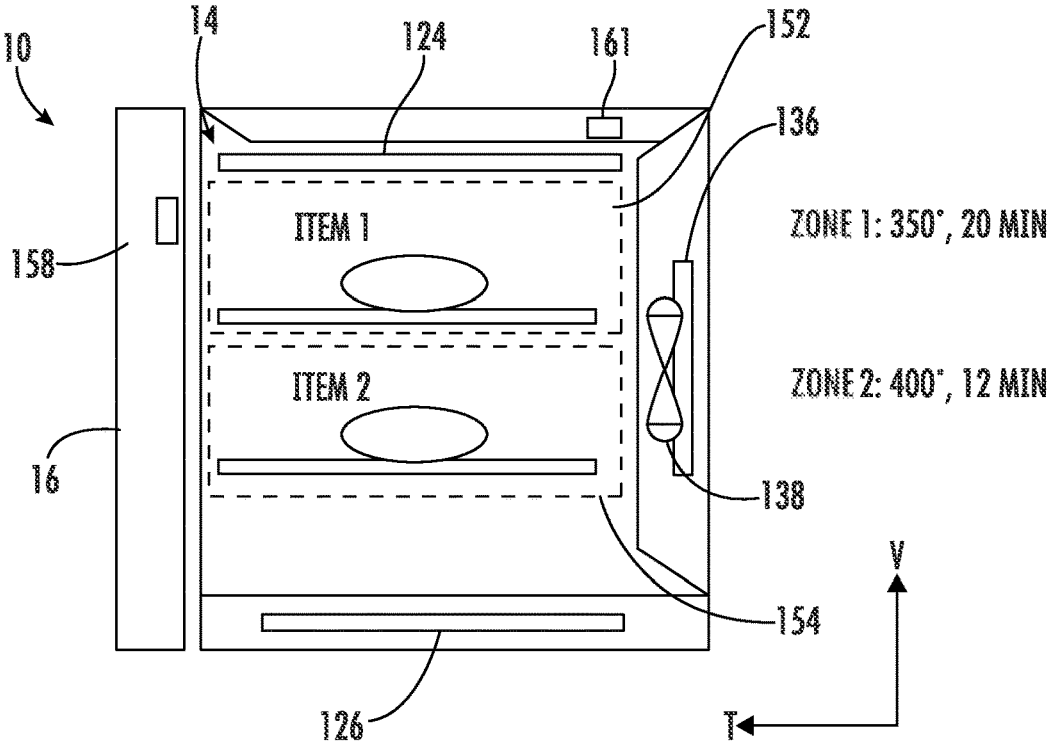
FIG. 2 provides a schematic side view representation of the cooking appliance of FIG. 1 illustrating multiple zones within a cooking chamber.

Referring now to FIG. 2, a schematic representation of cooking chamber 14 is provided. As shown in FIG. 2, cooking chamber 14 may be divided into several distinct heating zones. For instance, cooking chamber 14 may include a first heating zone, or zone 1 152, and a second heating zone, or zone 2 154. It should be understood that any suitable number of heating zones may be incorporated into cooking chamber 14, including more than two heating zones. Each of the heating zones may be spaced apart from one another (e.g., along the vertical direction V as shown, the lateral direction L, and/or transverse direction T). In other words, zone 1 152 may be spaced apart from zone 2 154, etc. Accordingly, each heating zone may be controlled separately from one another (e.g., to or at a different temperature or power level, using a different criterion, or using a different heating cycle).

As shown in FIG. 2, zone 1 152 may be defined within an upper half of cooking chamber 14 (e.g., along the vertical direction V) and zone 2 154 may be defined within a lower half of cooking chamber 14 (e.g., along the vertical direction V, beneath zone 1 152). In detail, zone 1 152 may encompass an entire upper half of cooking chamber 14 while zone 2 154 encompasses an entire lower half of cooking chamber 14. Each of zone 1 152 and zone 2 154 may be at least partially defined by one or more racks, for instance (e.g., provided along the lateral direction L and transverse direction T). Accordingly, a first cooking item (e.g., food item, cookware item, baking item, etc.) may be positioned within zone 1 152 while a second cooking item is positioned within zone 2 154. It should be noted that each of zone 1 152 and zone 2 154 may receive heat or be affected by each active heating element within cooking chamber 14.

It should further be noted that zone 1 152 may be defined within a first lateral side of cooking chamber 14 (e.g., a left side) and zone 2 154 may be defined within a second lateral side of cooking chamber 14 (e.g., a right side). According to this example, zone 1 152 encompasses an entire first lateral side of cooking chamber 14 (e.g., from a lateral midpoint of cooking chamber 14 to an inner wall of cooking chamber 14, from a top wall to a bottom wall, and from a back wall to door 16), while zone 2 154 encompasses an entire second lateral side of cooking chamber 14. For yet another example, zone 1 152 may be defined within a front portion of cooking chamber 14 while zone 2 154 may be defined within a rear portion of cooking chamber 14. Thus, zone 1 152 may encompass an entire front half of cooking chamber 14 (e.g., from a transverse midpoint of cooking chamber 14 to door 16, from the top wall to the bottom wall, and from the first lateral side to the second lateral side) while zone 2 154 encompasses an entire rear half of cooking chamber 14. Additionally or alternatively, each of the plurality of cooking zones defined within cooking chamber 14 may be arbitrarily defined or selected by a user when initiating a joint cooking operation. For instance, the user may have an option to select an upper zone, a lower zone, a left zone, a right zone, a front zone, a back zone, a central zone, or the like.

Further, one or more heating elements may be provided at the top, bottom, or both of cooking chamber 14, and may provide heat to cooking chamber 14 for cooking. Such heating element(s) can be gas, electric, microwave, or a combination thereof. For example, in the embodiment shown in FIG. 2, cooking appliance 10 includes a top heating element 124 positioned at a top of cooking chamber 14 and a bottom heating element 126 positioned at a bottom of cooking chamber 14. Other configurations may be used as well. For instance, multiple top heating elements 124 and multiple bottom heating elements 126 may be incorporated.

Cooking appliance 10 may also have a convection heating element 136 and/or convection fan 138 (e.g., collectively a convection heating assembly) positioned adjacent a back wall 116 of cooking chamber 14. Convection fan 138 may be powered by a convection fan motor. Further, convection fan 138 may be a variable speed fan—meaning the speed of fan 138 may be controlled or set anywhere between and including, e.g., zero and one hundred percent (0%-100%). According to at least one example, convection fan 138 is provided as a stand-alone fan (e.g., without an accompanying convection heating element). In certain embodiments, cooking appliance 10 also includes a bidirectional triode thyristor (not shown), i.e., a triode for alternating current (TRIAC), to regulate the operation of convection fan 138 such that the speed of fan 138 may be adjusted during operation of cooking appliance 10. The speed of convection fan 138 may be determined by controller 40. In addition, a sensor such as, e.g., a rotary encoder, a Hall effect sensor, or the like, may be included at the base of fan 138 to sense the speed of fan 138. The speed of fan 138 may be measured in, e.g., revolutions per minute ("RPM").

In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of cooking chamber 14. As another example, in some embodiments reversing the direction results in air being directed from the top and/or sides of cooking chamber 14 rather than the back of cooking chamber 14. Additionally or alternatively, an effective speed for convection fan 138 may be determined. The effective speed of fan 138 may include adjusting a rotational speed of the fan. Moreover, the effective speed may relate to a duty cycle of fan 138. For instance, an effective speed of fan 138 may incorporate a determined cycle of "ON' and "OFF" times (e.g., in addition to or apart from the rotational speed).

In various embodiments, more than one convection heater assembly, e.g., more than one convection heating element 136 and/or convection fan 138 may be provided. In such embodiments, the number of convection fans and convection heaters may be the same or may differ, e.g., more than one convection heating element 136 may be associated with a single convection fan 138. Similarly, top heating elements and/or bottom heating elements may be provided in various combinations, e.g., one top heating element with two or more bottom heating elements, two or more top heating elements 124, 126 with no bottom heating element, etc.

One or more sensors 158 may be provided within cooking chamber 14. The one or more sensors 158 may include, for instance, a camera. However, the one or more sensors 158 may include, in addition to or alternatively from the camera, an ultrasonic sensor, an infrared sensor, an optical sensor, or the like. It should be understood that the information or data collected by the camera may be obtained through any suitable sensor, such as the aforementioned ultrasonic sensor or optical sensor.

The image or images captured by the camera may be analyzed (e.g., within controller 40) to determine one or more attributes of a cookware item 160 within cooking chamber 14. For instance, the camera may capture an image of cookware item 160 (e.g., roasting pan, baking dish, cookie sheet, etc.) within first heating zone 152. The image may be analyzed to determine certain features of cookware item 160. For instance, the analysis may determine a material, an emissivity, a surface texture, a color, or the like of the cookware item. Such features may selectively alter a heating rate of the items (e.g., food items) or a particular associated cooking or heating zone (e.g., first heating zone 152, second heating zone 154) within cooking chamber 14. For instance, the attributes of cookware item 160 may affect thermal energy transfer of each of a first food item provided within first heating zone 152 and a second food item provided within second heating zone 154.

The one or more sensors may additionally include a temperature sensor 161. For instance, a single temperature sensor 161 may be provided within cooking chamber 14. Temperature sensor 161 may be positioned, for example, on a back wall, upper wall, or side wall of cooking chamber 14. Temperature sensor 161 may sense (e.g., selectively, continuously) a temperature within cooking chamber 14 (e.g., at predetermined intervals). Additionally or alternatively, temperature sensor 161 may transmit the sensed temperatures to controller 40.

As used herein, "temperature sensor" or the equivalent is intended to refer to any suitable type of temperature measuring system or device positioned at any suitable location for measuring the desired temperature. Thus, for example, the temperature sensor may be any suitable type of temperature sensor, such as a thermistor, a thermocouple, a resistance temperature detector, a semiconductor-based integrated circuit temperature sensors, etc. In addition, the temperature sensor may be positioned at any suitable location and may output a signal, such as a voltage, to a controller that is proportional to and/or indicative of the temperature being measured. Although exemplary positioning of temperature sensors is described herein, it should be appreciated that appliance 10 may include any other suitable number, type, and position of temperature, humidity, and/or other sensors according to alternative embodiments.

Figure 3:
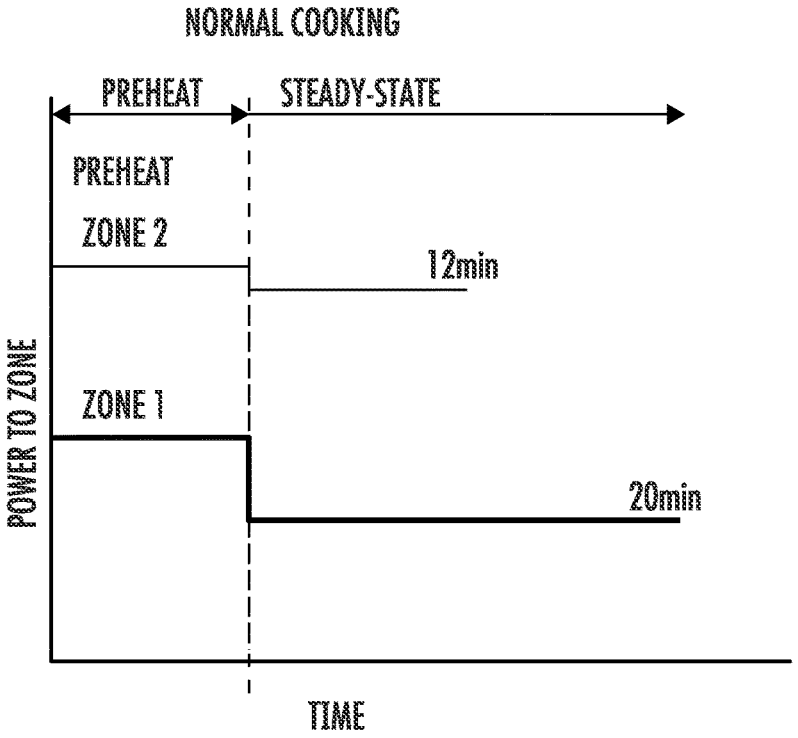
FIG. 3 provides a graphical representation of a cooking operation as a function of power level of heating elements versus time.

Referring briefly to FIG. 3, a graphical representation of heating element power levels with respect to time is shown. According to the embodiment described above, the first heating zone may be associated with a cooking temperature of 350° F. for 20 minutes. The second heating zone may be associated with a cooking temperature of 400° F. for 12 minutes. It should be noted that the values given herein are merely exemplary, and that any suitable combination of temperature and time may be incorporated. Moreover, as shown with the thin solid line and the dashed line in FIG. 3, various heating patterns may be incorporated to generate the desired results. In determining the synchronized cook time, cooking appliance 10 (e.g., controller 40) may determine a heating pattern for each heating zone. In detail, the heating pattern may be applied to a corresponding heating element that is nearest to a given or defined heating zone. In the embodiment shown, upper heating element 124 may be most closely associated with the first heating zone (and, e.g., food item 1), while lower heating element 126 may be most closely associated with the second heating zone (and, e.g., food item 2). As will be described in more detail below, each of upper heating element 124 and lower heating element 126 may be operated according to a determined pattern (e.g., start time, power level, duty cycle, etc.) in order to simulate the requested temperatures for the synchronized cook time. In at least one instance (FIG. 4), lower heating element 126 (zone 2) may be operated first during the preheat phase, may be deactivated (or operated at a low power level) for a first portion of the cooking phase, and may be operated at a predetermined power level (e.g., higher than the power level for the first portion of the cooking phase) for a second portion of the cooking phase. For another example (FIG. 7), lower heating element 126 (zone 2) is not operated (or operated at a low power level) during the preheat phase, operated at a predetermined power level for the first portion of the cooking phase, and not operated (or operated at a lower power level than the first portion of the cooking phase) during the second portion of the cooking phase. It should be understood that multiple suitable heating patterns may be determined according to input temperatures, defined zones, associated heating elements, cookware items, or the like. Additionally or alternatively, multiple duty cycles for the heating elements may be incorporated into each heating pattern.

Figure 4:
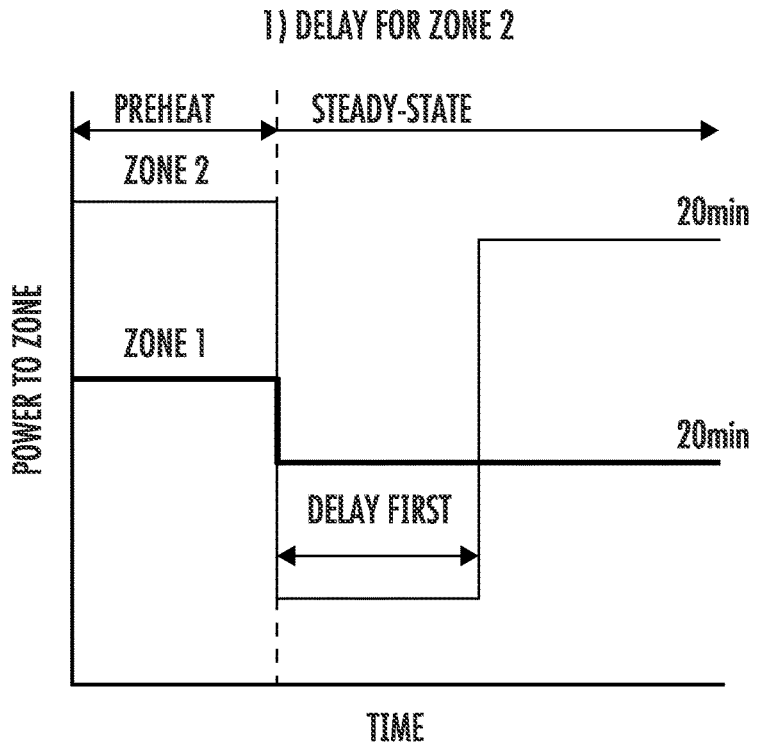
FIG. 4 provides a graphical representation of a cooking operation as a function of power level of heating elements versus time.

Referring now to FIG. 4, an exemplary selection process for initiating the joint cooking operation will be described. In detail, the user may select (e.g., via user interface assembly 62) the joint cooking operation. In some embodiments, the joint cooking operation is referred to as "Meal Cook," however any suitable reference may be used to indicate performing a cooking operation on multiple items requiring different temperatures within cooking chamber 14. User interface assembly 62 (e.g., display 66) may present the user with an option to select a first temperature. The temperature options may be provided to the user in predetermined increments (e.g., 10 degree increments, 25 degree increments, etc.). In some instances, the user may enter a custom temperature for the first temperature.

The first temperature may be associated with a first heating zone or cooking zone (or, in some instances, a first food item). The first temperature may thus be a temperature at which the first cooking zone (e.g., and/or the first food item) must or should be cooked. The first temperature may be an average temperature that the first cooking item should be exposed to (e.g., within cooking chamber 14). As described, the first cooking item may be a food item, a cookware item, a bake item, or the like. For instance, the first temperature may be a set temperature within cooking chamber 14 (e.g., within first heating zone 152) at which the first cooking item should be heated.

The user may select a zone (e.g., a heating zone such as first heating zone 152, second heating zone 154, etc.) with which the first temperature will be associated. The user may be presented with a plurality of potential zones. As described briefly above, the zone options may include a top zone, a bottom zone, a left zone, a right zone, a front zone, a back zone, or the like. Additional or alternative zones may be suggested, however, and the disclosure is not limited to the examples given herein. In some instances, a user may define a custom zone within cooking chamber 14.

The user may then be presented with a prompt to enter a cook or cooking time. In detail, the user may enter a first cooking time for the first heating zone (e.g., first heating zone 152). The first cooking time may be a total cooking time to fully cook a first food item within the first zone to the desired doneness (e.g., at the input first temperature). It should be noted that the input order of each parameter outlined above (e.g., first temperature, cooking zone, first cooking time, etc.) may be adjusted as required according to specific embodiments. For instance, some cooking operations may omit the selection of cooking zones (e.g., first heating zone 152, second heating zone 154, etc.). Thus, the user inputs would include the first cooking temperature and the first cooking time.

The user may then select a second temperature and a second cook time (e.g., either concurrently or separately). For instance, upon selecting the first temperature and the first cooking time, display 66 may present options for the second temperature and the second cooking time. The options for the second temperature may be limited and may be dependent on the first temperature. For instance, the possible selections for the second temperature may be limited to a range surrounding the first temperature. The range may be a predetermined amount above and below the first temperature. For the example given above, the range may be between 300° F. and 400° F. The range may vary according to specific embodiments, however.

Additionally or alternatively, the user (or the appliance) may select a corresponding zone, or heating zone (e.g., the second heating zone). For instance, upon selecting the first zone, cooking appliance 10 may automatically select the second zone to be complementary to the first zone. For example, if the top zone is selected as first heating zone 152, the bottom zone may be automatically selected as second heating zone 154.

Cooking appliance 10 (e.g., via display 66) may present an option to the user to synchronize the cook times (or cooking times). As will be described in further detail below, cooking appliance 10 may optionally calculate a synchronized (or joint) cooking time (or multiple synchronized cooking times) for each of the first cooking zone and the second cooking zone. The synchronized cooking time may accommodate each of the first temperature and the second temperature such that items placed in the first and second cooking zones are properly cooked within the synchronized cook time (e.g., by adjusting one or more parameters of the cooking sequence, heating elements, or the like, described below). In another embodiment, the synchronized cooking time includes two cooking times. For instance, the synchronization may reduce a longer cook time for one of the cooking zones while increasing a shorter cook time for the other cooking zone, such that the two cook times are closer together. Advantageously, the number of times a user manipulates or otherwise interacts with cooking appliance 10 (e.g., to insert or remove food items) may be reduced.

Figure 9:
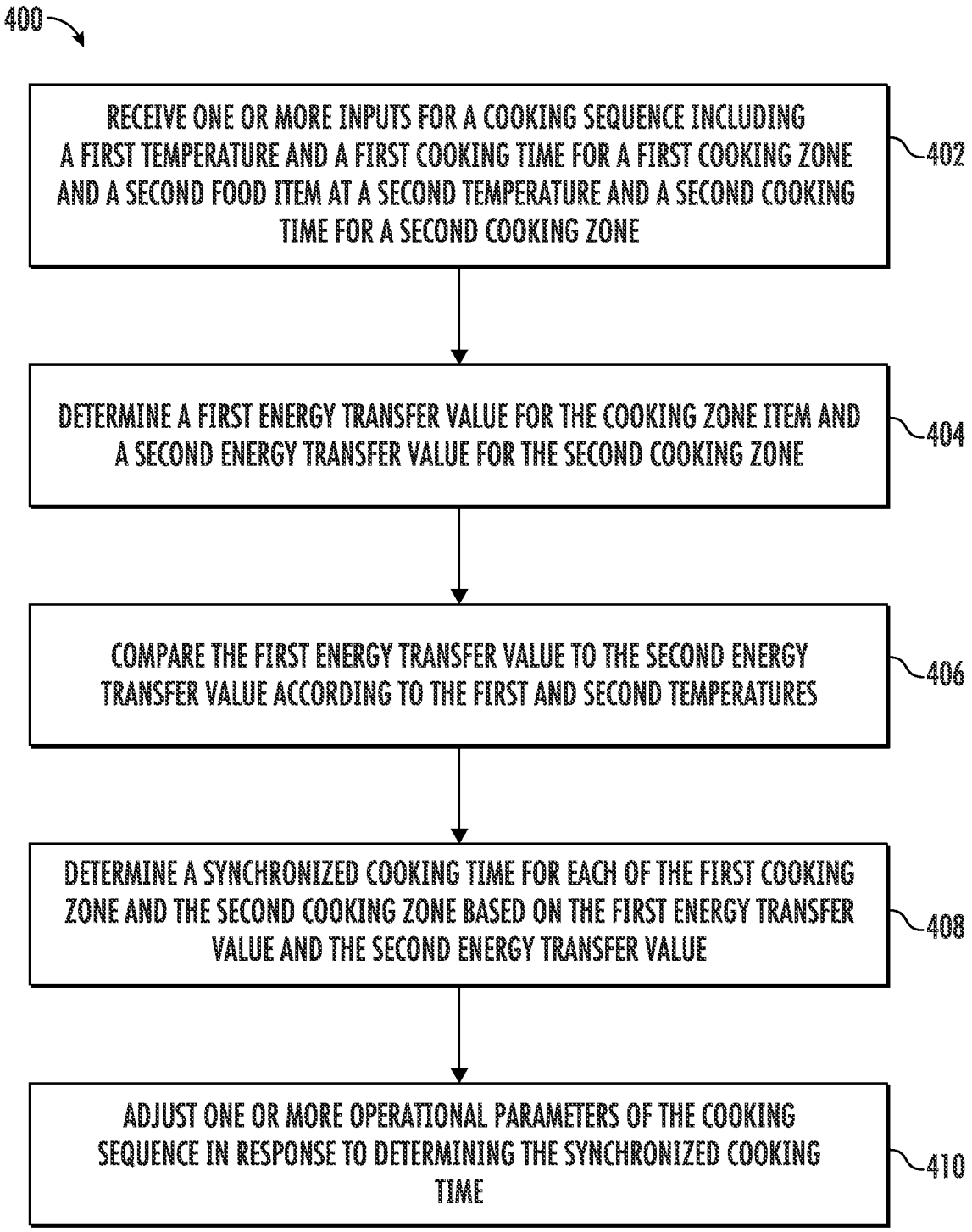
FIG. 9 provides a flow chart illustrating a method of operating a cooking appliance according to exemplary embodiments of the present disclosure.

Now that the general descriptions of an exemplary appliance have been described in detail, a method 400 of operating an appliance (e.g., cooking appliance 10) will be described in detail. Although the discussion below refers to the exemplary method 400 of operating cooking appliance 10, one skilled in the art will appreciate that the exemplary method 400 is applicable to any suitable domestic appliance capable of performing a cooking operation (e.g., such as a cooktop appliance, a stand-alone oven, etc.). In exemplary embodiments, the various method steps as disclosed herein may be performed by controller 40 and/or a separate, dedicated controller. FIG. 9 provides a flow chart illustrating a method of operating a cooking appliance. Hereinafter, method 400 will be described with specific reference to FIG. 9.

At step 402, method 400 may include receiving one or more inputs for a cooking sequence. The cooking sequence may include a first temperature and a second temperature. The first temperature may be different from the second temperature. For instance, with reference to the above example and FIGS. 2 and 4, the first temperature may be less than the second temperature. Additionally or alternatively, the one or more inputs may include assigning a cooking zone for each of the first temperature and the second temperature. For one example, the user inputs the first temperature and the first cooking zone (e.g., a top zone) for a first food item, and inputs the second temperature and the second cooking zone (e.g., a bottom zone) for a second food item. It should be noted that additional cooking zones may be associated with additional temperatures, and the disclosure is not limited to the examples given herein.

The one or more inputs may include cooking times for each of the first cooking zone and the second cooking zone. For instance, upon inputting the cooking temperature for the first cooking zone (e.g., the first temperature), a first cooking time may be input for the first cooking zone (e.g., to the user input). Moreover, upon inputting the cooking temperature for the second cooking zone (e.g., the second temperature), a second cooking time may be input for the second cooking zone (e.g., to the user input). The second cooking time may be different from the first cooking time. Accordingly, the first cooking zone may have a first cooking temperature and a first cooking time and the second cooking zone may have a second cooking temperature and a second cooking time, each of the first cooking temperature and the first cooking time being different from the second cooking temperature and the second cooking time.

After receiving the one or more inputs, as step 404, method 400 may include determining a first energy transfer value for the first cooking zone and a second energy transfer value for the second cooking zone. In detail, the energy transfer values may be determined using the input information from step 402. The energy transfer values may be determined (or calculated) according to the input cooking temperatures and the input cooking times for each of the first cooking zone and the second cooking zone. For instance, a first energy transfer value (or parameter) may be determined by multiplying a first absolute temperature with the first cooking time, while a second energy transfer value (or parameter) may be determined by multiplying a second absolute temperature with the second cooking time.

The first absolute temperature may be determined by subtracting an ambient temperature from the first temperature (e.g., as input to the user interface in step 402). According to one example, when the ambient temperature is 70° F. and the first cooking temperature is 350° F., the first absolute temperature may be 350° F.-70° F., or 280° F. Similarly, the second absolute temperature may be determined by subtracting the ambient temperature from the second temperature (e.g., as input to the user interface in step 402). Thus, according to another example, when the second cooking temperature is 400° F. (and the ambient temperature is 70° F.), the second absolute temperature may be 400° F.-70° F., or 330° F. It should be noted that the values provided herein are merely exemplary, and that the absolute temperatures may be determined or calculated according to specific inputs at each iteration of the method 400.

According to some additional or alternative embodiments, determining the energy transfer values (or parameters) includes integrating heat transfer values (e.g., according to radiant heat properties, convective heat properties, cookware properties, or the like). For instance, a radiation scaling of heat transfer between the one or more heating elements and each food item (or cookware item containing the food item) may be incorporated, such that a nonlinear comparison between temperature differences is calculated to determine each energy transfer value. Further, a combination of one or more methods or equations may be used to determine each energy transfer value.

At step 406, method 400 may include comparing the first energy transfer value to the second energy transfer value according to the first and second temperatures. In detail, upon determining each of the first and second energy transfer values, the method 400 may compare the two to determine whether the first and second food items (e.g., provided within each of the first cooking zone and the second cooking zone, respectively) can be cooked together in a relatively equal amount of time. Referring briefly to FIG. 2 and the example given above, the first food item within the first cooking zone is to be cooked at 350° F. for 20 minutes, while the second food item within the second cooking zone is to be cooked at 400° F. for 12 minutes. Using the exemplary energy transfer values described above, this would result in a first energy transfer value (e.g., for the first food item) of 280° F. (e.g., 350–70)*20 minutes, or 5,600 (e.g., degree-minutes). Similarly, the second energy transfer value may be 330° F. (e.g., 400–70)*12 minutes, or 3,960 (e.g., degree-minutes).

Thus, it may be inferred that more energy is required within the first cooking zone than is required within the second cooking zone. Additional or alternative equations or parameters may be further included in comparing the energy transfer values, such as cookware selection, placement within the cooking chamber (e.g., specific applied heating zones), preheat operations, heating element usage (e.g., a top broiler element versus a bottom bake element versus a convection assembly), or the like. For instance, in comparing the first and second energy transfer values, the method 400 may place different weighted values on cook time lengths or cooking temperatures.

At step 408, method 400 may include determining a synchronized cooking time for each of the first cooking zone and the second cooking zone based on the first energy transfer value and the second energy transfer value. For instance, upon comparing the first and second energy transfer values, the method 400 may determine or otherwise compute a synchronized cooking time such that each of the first and second food items are cooked in similar time frames. For at least one example, the method 400 calculates a new cooking time for the first cooking zone and a new cooking time for the second cooking zone. The new cooking time for the first cooking zone may be the same as the new cooking time for the second cooking zone. Accordingly, the synchronized cooking time may be a single cooking time for both cooking zones. Referring briefly to FIG. 4, the synchronized cooking time may be the longer of two cooking times input to the appliance (e.g., 20 minutes for each of the first cooking zone and the second cooking zone).

In additional or alternative embodiments, the synchronized cooking time may include two adjusted cooking times. For instance, the first cooking time may be adjusted in one direction while the second cooking time is adjusted in the opposite direction. In some embodiments, as mentioned above, the synchronized cook time may adjust the first cooking time (e.g., cook time 1) to a first synchronized cooking time (e.g., 18 minutes), and may adjust the second cooking time (e.g., cook time 2) to a second synchronized cooking time (e.g., 13 minutes). As can be seen, the difference in cooking times may be reduced (e.g., from 8 minutes to 5 minutes). Advantageously, multiple food items with varying cooking parameters may be completed closer together.

While performing certain calculations to determine the synchronized cooking time, the method 400 may compare a temperature difference between the first and second temperatures with a temperature threshold. For instance, the first temperature (e.g., at which the first cooking zone is to be maintained or emulated) may be compared against the second temperature (e.g., at which the second cooking zone is to be maintained or emulated). The method 400 may determine that the difference between the first and second temperatures is above a temperature threshold such that the joint cooking operation cannot be completed. The temperature threshold may be about 100° F. Accordingly, if the first temperature is less than (or greater than) the second temperature by more than the temperature threshold, the method 400 may provide (or emit) an alert notification to the user. The alert notification may be presented via the user interface, via a remote connected device, or the like.

Similarly, the method 400 may compare the determined synchronized cooking time against a threshold time (e.g., a threshold cooking time). For instance, the method 400 may determine that the cooking times for each of the first cooking zone and the second cooking zone differ by at least a predetermined time threshold. For instance, the first cooking zone may require a cooking time of about 30 minutes while the second cooking zone requires a cooking time of about 8 minutes. Thus, the method 400 may determine that the combination cannot be cooked according to a satisfactory result. The alert notification may then be presented to the user (e.g., via the user interface, remote device, etc.). Additionally or alternatively, the alert notification may present optimal cooking zones for each temperature-time pair. For instance, if the first temperature-time pair is likely to perform better according to the top broiler heating element, the method 400 may recommend associating the first temperature-time pair with the top heating zone. In recommending the cooking zones, the method 400 may determine one or more heat transfer parameters relating to the input temperature (e.g., the first temperature, the second temperature), the input cook time (e.g., the first cook time, the second cook time), cookware attributes, heating element proximity, or the like. Accordingly, a different heating (cooking) zone from the one selected may be recommended.

At step 408, method 400 may additionally include determining a heating pattern for each of the plurality of heating elements such that each of the determined first energy transfer value and the determined second energy transfer value are satisfied over the synchronized cooking time. In detail, upon determining that the synchronized cooking time is applicable to the first and second cooking zones, a heating pattern for each of the plurality of heating elements may be determined. The heating pattern may include a power level, a duty cycle schedule, an operation time or time limit, a start time, a delay time, a target temperature as measured by the temperature sensor, or the like. A separate and unique heating pattern may be determined for each of the plurality of heating elements. For instance, the top broil heating element may have a first heating pattern, the bottom bake heating element may have a second heating pattern, and the convection assembly may have a third heating pattern. Additionally or alternatively, only one or two of the heating elements may be incorporated or adjusted.

As mentioned briefly above, the cooking sequence may include a cook phase and a preheat phase performed before the cook phase. A first heating pattern may be determined for the preheat phase while a second heating pattern may be determined for the cook phase. In some embodiments, only a single heating pattern is determined for the cook phase. For instance, the preheat phase may be performed according to standard or unadjusted operational parameters while a unique heating pattern is incorporated for the cook phase. Additionally or alternatively, a temperature at which the preheat phase is considered completed (e.g., as measured by temperature sensor 161) may be adjusted to synchronizing the cook times. For instance, one adjusted heating pattern may complete the preheat phase at a temperature that is less than the first temperature request or the second temperature request.

At step 410, method 400 may include adjusting one or more operational parameters of the cooking sequence in response to determining the synchronized cooking time. In detail, upon determining the heating pattern for each of the heating elements, the method 400 may incorporate one or more adjustments to the cooking sequence in order to implement the heating patterns. The one or more operational parameters may include the total cooking time for the first cooking zone, the average simulated cooking temperature of the first cooking zone, the total cooking time for the second cooking zone, the average simulated cooking temperature of the second cooking zone, or the like.

As mentioned above, the power level, duty cycle, or the like of a particular heating element may be adjusted according to the synchronized cooking time. For instance, referring again to the example given above along with FIGS. 2 and 3, a proximate heating element may be primarily associated with each cooking zone. The first food item may be located within a top zone of the cooking chamber (e.g., proximate the top broil heating element) while the second food item is located within a bottom zone of the cooking chamber (e.g., proximate the bottom bake heating element). Accordingly, the top broil heating element may be primarily associated with the first food item (or first cooking zone such as the top zone) while the bottom bake heating element may be primarily associated with the second food item (or second cooking zone such as the bottom zone).

Upon determining the synchronized cooking time and the heating patterns, the method 400 may adjust one or more of the heating elements (e.g., power level, start time, duty cycle, etc.). For instance, when the average simulated cooking temperature of the second cooking zone is lowered (e.g., according to the synchronized cooking time), the method 400 may adjust a start time of the bottom bake heating element to be on a delay. The delay may be according to a determined amount of time (e.g., in minutes) to allow for the first cooking zone to receive proper heat energy. Referring again to the above example together with FIGS. 3 through 7, as the cook time for the first cooking zone is longer than the cook time for the second cooking zone, the top broil heating element (e.g., proximate and primarily associated with the first food item or cooking zone) may be adjusted to activate before the bottom bake heating element (e.g., proximate and primarily associated with the second food item or cooking zone).

Figure 5:
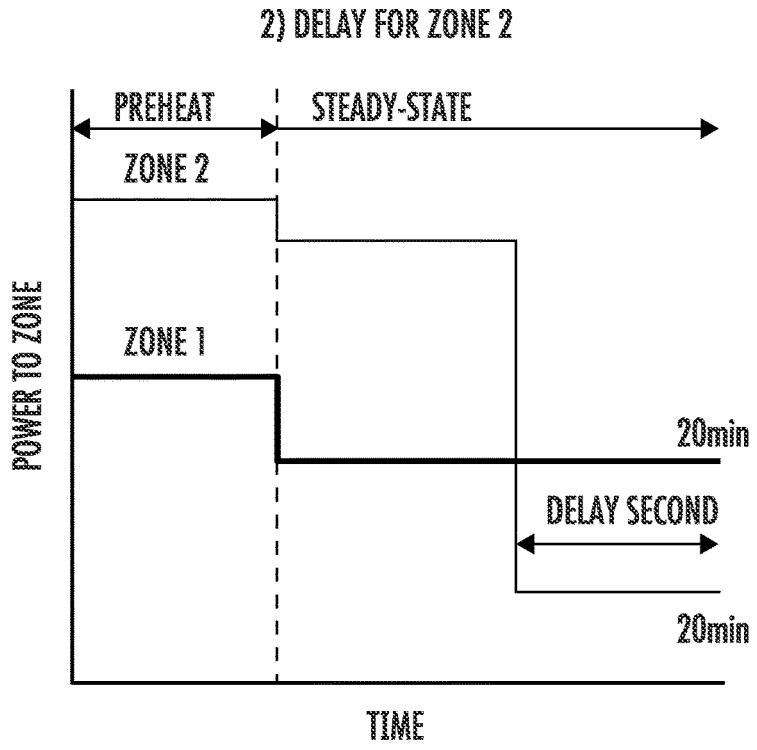
FIG. 5 provides a graphical representation of a cooking operation as a function of power level of heating elements versus time.

In some embodiments, the delay associated with the selected heating element (e.g., the bottom bake heating element) may be implemented at select times during the cook phase of the cooking sequence. In one embodiment, the delay is implemented at the initiation of the cook phase (e.g., as shown in FIG. 4). Upon the expiration of the delay, the selected heating element (e.g., the bottom bake heating element) may be activated at the determined power level (e.g., according to the determined heating pattern). In another embodiment, the delay is implemented after an activation period during the cook phase. For instance, as shown in FIG. 5, the selected heating element may be activated at the determined power level for a certain determined amount of time (e.g., a percentage of the cook phase) before being deactivated for the delay time. Additionally or alternatively, the delay time may incorporate a reduced power of the selected heating element.

Figure 6:
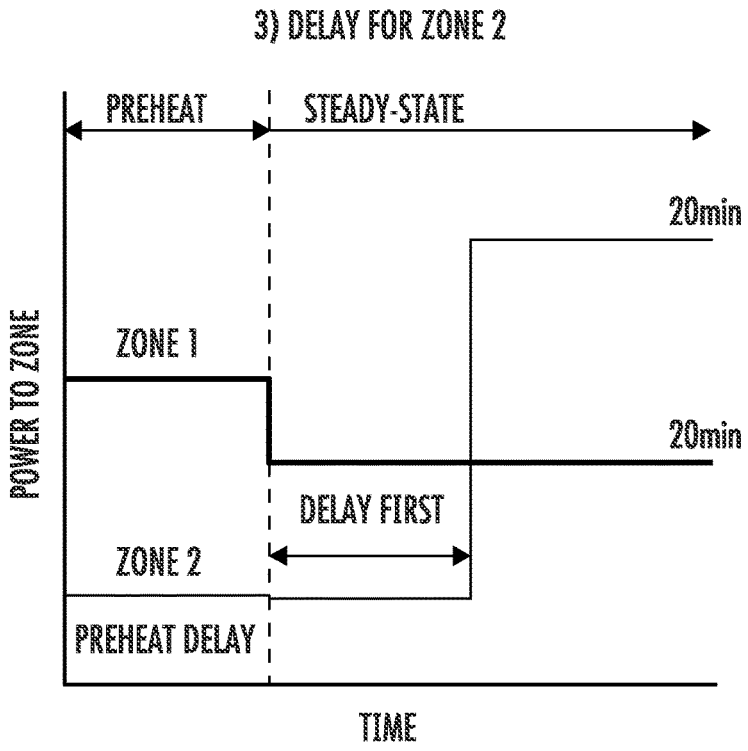
FIG. 6 provides a graphical representation of a cooking operation as a function of power level of heating elements versus time.
Figure 7:
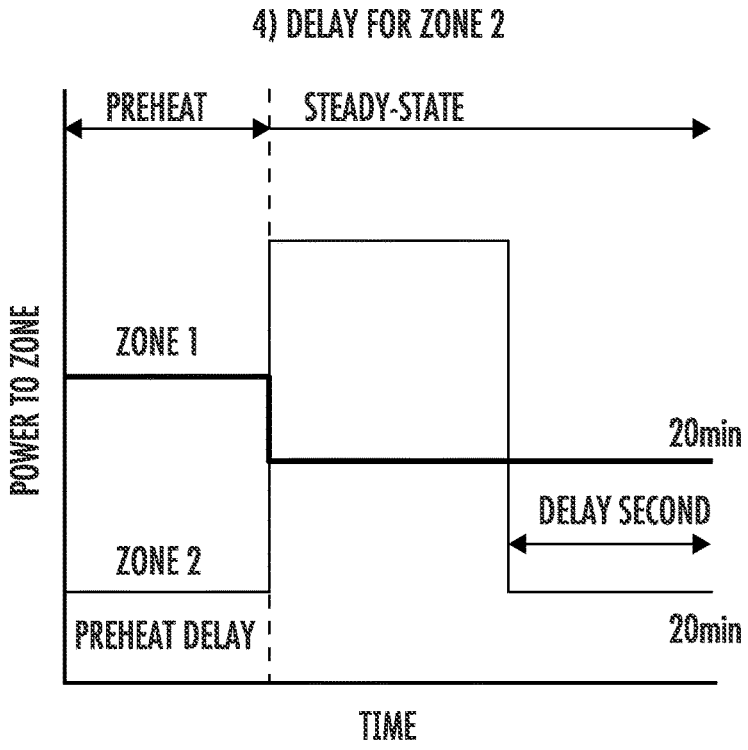
FIG. 7 provides a graphical representation of a cooking operation as a function of power level of heating elements versus time.
Figure 8:
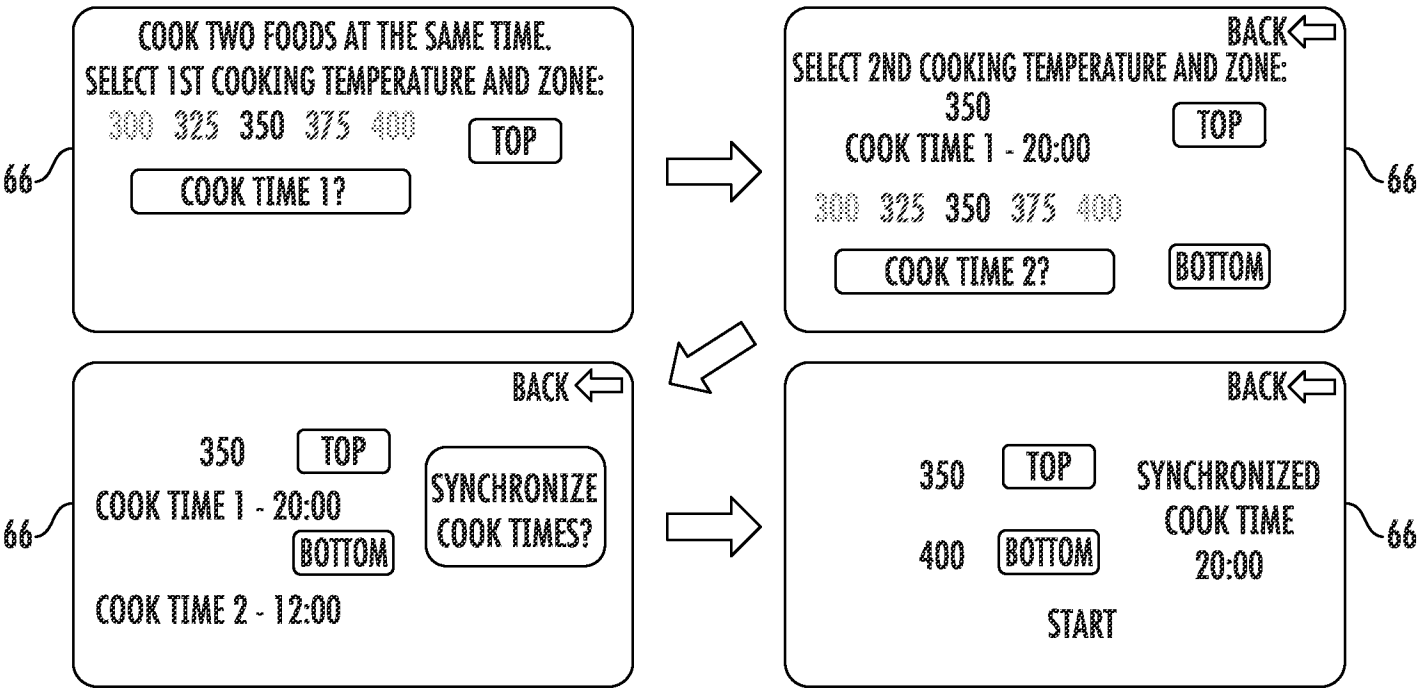
FIG. 8 provides a schematic representation of a display of the exemplary cooking appliance of FIG. 1.

The adjusted operational parameters may include determined parameters during the preheat phase. Referring to FIGS. 4 and 5, each of the first associated heating element (e.g., the top broil heating element to the first food item) and the second associated heating element (e.g., the bottom bake heating element to the second food item) may be driven at a preheat power level for the duration of the preheat phase. The preheat power level may be different from the cook power level. For instance, the preheat power level (e.g., for each of the first and second associated heating elements) may be greater than the cook power level (e.g., during the cook phase). However, it should be understood that the preheat power level for each of the first and second associated heating elements may vary according to specific embodiments, including varying duty cycles, percentage power levels, start times, preheat exit temperature, preheat exit time, etc. Accordingly, a temperature of the cooking chamber may be adjusted or controlled when transitioning from the preheat phase to the cook phase. Additionally or alternatively, one of the heating elements (e.g., the bottom bake heating element) may be deactivated (or operated at a reduced power level) during the preheating phase. Referring to FIGS. 6 and 7, the heating element associated with the first zone (e.g., the top broil heating element) may be activated during the preheating phase while the bottom bake element associated with the second zone is not operated (or operated at a reduced power level). Accordingly, as can be seen in FIGS. 3 through 7, a delay may be instituted for at least one of the heating elements at various times during each of the preheating phase and the cooking phase.

The method 400 may further include initiating the cooking sequence according to the one or more adjusted operating parameters. In some embodiments, the cooking sequence includes each of the preheat phase and the cook phase. Moreover, the cooking sequence may require (or suggest) that the first food item, the second food item, or each of the first food item and the second food item be placed within the cooking chamber before initiating the preheat phase. Advantageously, multiple food items provided in a single oven cavity (e.g., cooking chamber) may be cooked together and intelligently scheduled to finish at or near a single time point.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:

a cabinet forming a cooking chamber, the cooking chamber defining a plurality of cooking zones therein;

a plurality of heating elements provided within the cooking chamber;

a user interface configured to receive inputs; and a controller operably connected with the plurality of heating elements and the user interface, the controller configured to perform an operation, the operation comprising:

receiving a first input for a cooking sequence, the first input comprising a first temperature and a first cooking time for a first cooking zone of the plurality of cooking zones;

receiving a second input for the cooking sequence, the second input comprising a second temperature and a second cooking time for a second cooking zone of the plurality of cooking zones;

determining a first energy transfer value for the first cooking zone and a second energy transfer value for the second cooking zone;

comparing the first energy transfer value to the second energy transfer value according to the first and second temperatures;

determining a synchronized cooking time for each of the first cooking zone and the second cooking zone based on the first energy transfer value and the second energy transfer value; and adjusting one or more operational parameters of the cooking sequence in response to determining the synchronized cooking time.

2. The cooking appliance of claim 1, wherein determining the first energy transfer value comprises:

multiplying a first absolute temperature with the first cooking time, wherein the first absolute temperature is the first temperature minus an ambient temperature.

3. The cooking appliance of claim 1, wherein the operation further comprises:

determining that the first temperature differs from the second temperature by a predetermined amount; and providing an alert notification via the user interface.

4. The cooking appliance of claim 1, wherein the operation further comprises:

determining that the first cooking time differs from the second cooking time be a predetermined amount; and providing an alert notification via the user interface.

5. The cooking appliance of claim 1, wherein determining the synchronized cooking time for each of the first cooking zone and the second cooking zone comprises:

determining a heating pattern for each of the plurality of heating elements such that each of the determined first energy transfer value and the determined second energy transfer value are satisfied over the synchronized cooking time.

6. The cooking appliance of claim 1, wherein adjusting the one or more operational parameters of the cooking sequence comprises:

adjusting a total cooking time for the first cooking zone;

adjusting a first heating pattern associated with the first cooking zone;

adjusting a total cooking time for the second cooking zone; and adjusting a second heating pattern associated with the second cooking zone.

7. The cooking appliance of claim 1, wherein the cooking sequence comprises a cook phase, and wherein adjusting the one or more operational parameters of the cooking sequence comprises adjusting one of a power level, a duty cycle, a target temperature, or a start time of each of the plurality of heating elements during the cook phase.

8. The cooking appliance of claim 1, wherein the cooking sequence comprises a preheat phase, and wherein adjusting the one or more operational parameters of the cooking sequence comprises adjusting a temperature of the cooking chamber when transitioning from the preheat phase to a cook phase.

9. The cooking appliance of claim 8, wherein adjusting the one or more operational parameters of the cooking sequence comprises:

adjusting one of a power level, a duty cycle, a target temperature, or a start time of each of the plurality of heating elements during the preheat phase.

10. A method of operating a cooking appliance, the cooking appliance comprising a cooking chamber defining a plurality of cooking zones, a plurality of heating elements provided within the cooking chamber, and a user interface configured to receive inputs, the method comprising:

receiving a first input for a cooking sequence, the first input comprising a first temperature and a first cooking time for a first cooking zone of the plurality of cooking zones;

receiving a second input for the cooking sequence, the second input comprising a second temperature and a second cooking time for a second cooking zone of the plurality of cooking zones;

determining a first energy transfer value for the first cooking zone and a second energy transfer value for the second cooking zone;

comparing the first energy transfer value to the second energy transfer value according to the first and second temperatures;

determining a synchronized cooking time for each of the first cooking zone and the second cooking zone based on the first energy transfer value and the second energy transfer value; and adjusting one or more operational parameters of the cooking sequence in response to determining the synchronized cooking time.

11. The method of claim 10, wherein determining the first energy transfer value comprises:

multiplying a first absolute temperature with the first cooking time, wherein the first absolute temperature is the first temperature minus an ambient temperature.

12. The method of claim 10, further comprising:

determining that the first temperature differs from the second temperature by a predetermined amount; and providing an alert notification via the user interface.

13. The method of claim 10, further comprising:

determining that the first cooking time differs from the second cooking time be a predetermined amount; and providing an alert notification via the user interface.

14. The method of claim 10, wherein determining the synchronized cooking time for each of the first cooking zone and the second cooking zone comprises:

determining a heating pattern for each of the plurality of heating elements such that each of the determined first energy transfer value and the determined second energy transfer value are satisfied over the synchronized cooking time.

15. The method of claim 10, wherein adjusting the one or more operational parameters of the cooking sequence comprises:

adjusting a total cooking time for the first cooking zone;

adjusting a first heating pattern associated with the first cooking zone;

adjusting a total cooking time for the second cooking zone; and adjusting a second heating pattern associated with the second cooking zone.

16. The method of claim 10, wherein the cooking sequence comprises a cook phase, and wherein adjusting the one or more operational parameters of the cooking sequence comprises adjusting one of a power level, a duty cycle, a target temperature, or a start time of each of the plurality of heating elements during the cook phase.

17. The method of claim 10, wherein the cooking sequence comprises a preheat phase, and wherein adjusting the one or more operational parameters of the cooking sequence comprises adjusting a temperature of the cooking chamber when transitioning from the preheat phase to a cook phase.

18. The method of claim 17, wherein adjusting the one or more operational parameters of the cooking sequence comprises:

adjusting one of a power level, a duty cycle, a target temperature, or a start time of each of the plurality of heating elements during the preheat phase.

19. The method of claim 10, wherein determining a synchronized cooking time for each of the first cooking zone and the second cooking zone comprises:

determining a first synchronized cooking time for the first cooking zone, the first synchronized cooking time being either greater than or less than the first cooking time; and determining a second synchronized cooking time for the second cooking zone, the second synchronized cooking time being either greater than or less than the second cooking time, wherein when the first synchronized cooking time is less than the first cooking time, the second synchronized cooking time is greater than the second cooking time and when the first synchronized cooking time is greater than the first cooking time, the second synchronized cooking time is less than the second cooking time.

20. A cooking appliance comprising:

a cabinet forming a cooking chamber, the cooking chamber defining a plurality of cooking zones therein;

a plurality of heating elements provided within the cooking chamber;

a user interface configured to receive inputs; and a controller operably connected with the plurality of heating elements and the user interface, the controller configured to perform an operation, the operation comprising:

receiving a first input for a cooking sequence, the first input comprising a first temperature and a first cooking time for a first cooking zone of the plurality of cooking zones;

receiving a second input for the cooking sequence, the second input comprising a second temperature and a second cooking time for a second cooking zone of the plurality of cooking zones;

determining a first energy transfer value for the first cooking zone and a second energy transfer value for the second cooking zone;

comparing the first energy transfer value to the second energy transfer value according to the first and second temperatures;

determining a synchronized cooking time for each of the first cooking zone and the second cooking zone based on the first energy transfer value and the second energy transfer value.

* * * * *